US005328186A

United States Patent [19]

Hanson et al.

[11] Patent Number: 5,328,186

[45] Date of Patent: Jul. 12, 1994

[54] GOLFER'S STANCE GUIDE

[76] Inventors: Richard A. Hanson; Gregory S. Petree, both of P.O. Box 5043, Shawnee, Okla. 74801

[21] Appl. No.: 73,361

[22] Filed: Jun. 7, 1993

[51] Int. Cl.[5] ..... A63B 69/36

[52] U.S. Cl. ..... 273/187 R; 273/188 A; 273/188 R

[58] Field of Search ..... 273/187 R, 188 R, 188 A, 273/187 A, 187 B, 187.1, 191 R, 192

[56] References Cited

U.S. PATENT DOCUMENTS

| | | | |
|---|---|---|---|
| 2,169,407 | 8/1939 | Crowley | 372/187 R |
| 2,457,351 | 12/1948 | Crowley | 273/187 R |
| 2,886,326 | 5/1959 | Olds | 273/187 |
| 3,244,421 | 4/1966 | Hanna | 273/187 R |
| 3,348,268 | 9/1967 | Schennum | 273/187 R |
| 3,638,950 | 2/1972 | Hyotlaine | 273/187 R |
| 3,868,116 | 2/1975 | Ford et al. | 273/192 |
| 4,784,393 | 11/1988 | Williams et al. | 273/187 |
| 5,069,456 | 12/1991 | Bellagamboy | 273/187 R |
| 5,083,789 | 1/1992 | Hickson | 273/187 |
| 5,197,739 | 3/1993 | Johnson, III | 273/187 R |
| 5,203,453 | 4/1993 | Dirito | 206/315.3 |

FOREIGN PATENT DOCUMENTS

| | | | |
|---|---|---|---|
| 1229318 | 4/1971 | United Kingdom | 273/186.1 |
| 2194448 | 3/1988 | United Kingdom | 273/187 R |

*Primary Examiner*—Mark S. Graham
*Attorney, Agent, or Firm*—Robert K. Rhea

[57] ABSTRACT

A golfer's stance guide is formed by a tubular U-shaped member having a telescoping straight bight portion normal to the axis of the respective leg of the U-shape which is telescopically expanded or collapsed to measure the distance across a golfer's shoulders. The spacing between the legs is the guide for the placement of a golfer's shoe sides adjacent the guide, legs and shoe toes adjacent the respective end portion of the bight portion and the side of his shoe adjacent the respective leg to achieve an optimum stance for each individual golfer.

2 Claims, 2 Drawing Sheets

GOLFER'S STANCE GUIDE

BACKGROUND OF THE INVENTION

This invention relates to golfing and more particularly to a guide for self correction training a golfer's stance while driving or putting.

FIELD OF THE INVENTION

In playing golf, accuracy is of utmost importance. The accuracy takes several forms: accuracy in driving the ball to the target hole; accuracy in the placement of the golf club head relative to the ball; accuracy in the golfer's stance relative to the ball and the target; accuracy of swing in driving the ball; and, accuracy in chipping and putting.

Desired accuracy is difficult to achieve and repeat for each driving or putting stroke. Most golfers find it difficult to repeat an accurate or precision shot of a ball toward the target whether it be in driving or putting.

Further, through error many golfers develop a habit in driving or putting which is detrimental to obtaining the desired accuracy of ball putting or driving toward the target.

This invention permits a golfer to develop and repeat an optimum stance, driving swing and putting strokes by repeated practice when using this device on or off a golf course and results in a desired stance and swing while playing golf for pleasure or in a tournament.

DESCRIPTION OF THE PRIOR ART

The prior art discloses a number of golf stance teaching devices. A number of which disclose T-shaped devices placeable upon the ground in which an elongated member projects from the guide to or near the ball to be driven. U.S. Pat. No. 2,886,326, issued May 12, 1959 to Olds for GOLF STANCE GUIDE, U.S. Pat. No. 4,784,393, issued Nov. 15, 1988 to Williams et al for GOLF SWING TRAINING DEVICE and U.S. Pat. No. 5,083,789, issued Jan. 28, 1992 to Hickson for GOLF STANCE ALIGNMENT AND TRAINING DEVICE are examples of the T-shaped stance guides.

The guides of these patents further include feet placement members rigidly or pivotally connected with a base member for the placement of a golfer's feet in achieving a stance.

Other patents such as U.S. Pat. No. 5,203,453 issued Apr. 20, 1993 to Dirito for GOLF STANCE DEVICE is an example of the further state-of-the-art.

This invention is distinctive over these patents by providing a U-shaped member having a telescopically extensive bight portion normal to the axis of the respective leg which is manually adjusted to equal the measurement across the golfer's shoulders which determines the spacing between a golfer's feet defining the optimum stance of an individual golfer.

SUMMARY OF THE INVENTION

An inverted U-shaped member having a telescoping straight bight portion with its axis normal to the axis of its respective laterally projecting parallel legs forms a substantially square, one open side, enclosure having a dimension between the legs which is adjustably set to be slightly greater than an across-the-shoulder measurement of a user by which a desired square stance may be achieved by a golfer in placement of his feet adjacent the respective leg of the device with his toes adjacent the respective end of the bight portion.

Indicia scored on the bight portion indicates increments of measure in respective directions from its center for ball placement and other alignments.

An elongated rod having a length at least as great the distance between the parallel legs is disposed adjacent and parallel with the desired path of a ball to be driven toward a target and acts as a guide for placing the bight portion of the U-shaped member parallel with the rod and desired direction of golf ball movement.

Indicia scored on the end portion of each leg adjacent the bight portion indicates like increments of measure governing the placement of the right or left foot of a golfer in achieving a predetermined stance, such as square stance, closed stance or open stance.

An elongated dowel vertically supported by apertures intermediate the ends of one of the legs acts as a deterrent for minimizing unwanted sway during a golf driving swing.

The principal object of this invention is to provide a collapsible training guide by which a golfer may develop a precision drive shot by a proper stance, swing and follow through and accurate putting on a green which, when once achieved, may be repeated by consistent practice and using this guide.

DESCRIPTION OF THE PREFERRED EMBODIMENTS

Figure 1:
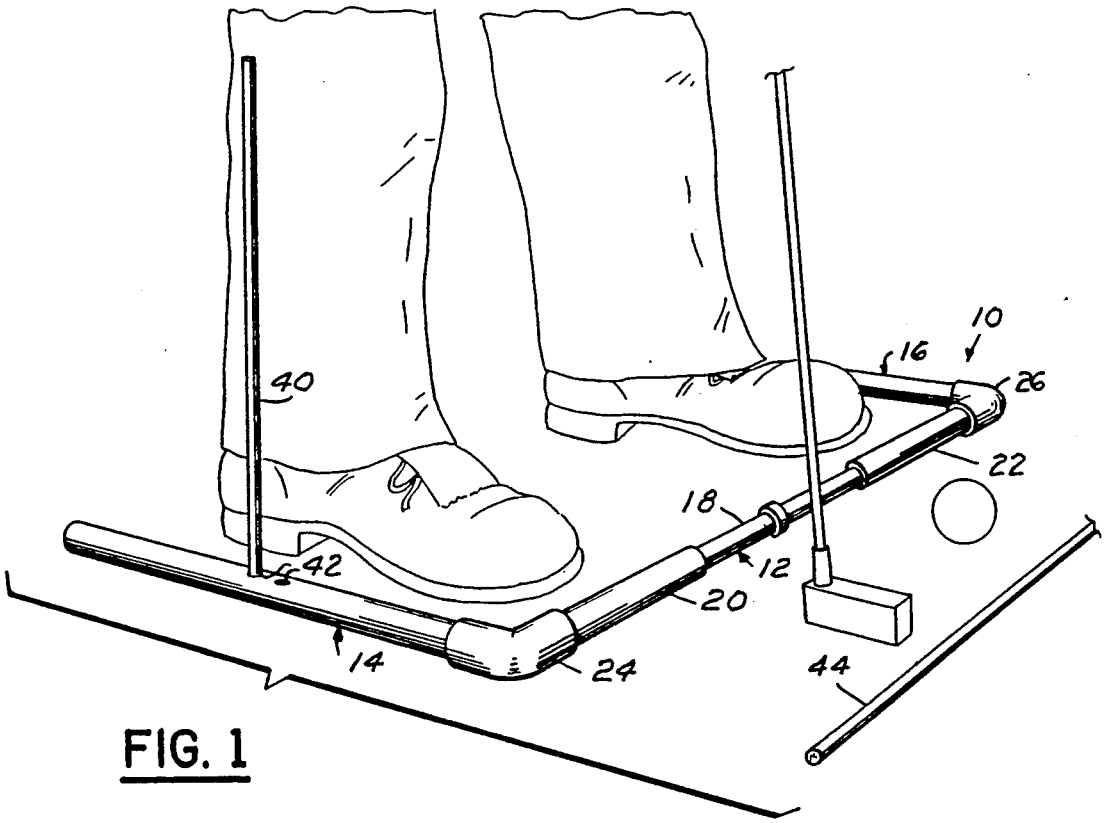
FIG. 1 is a perspective view of the components in operative position.
Figure 2:
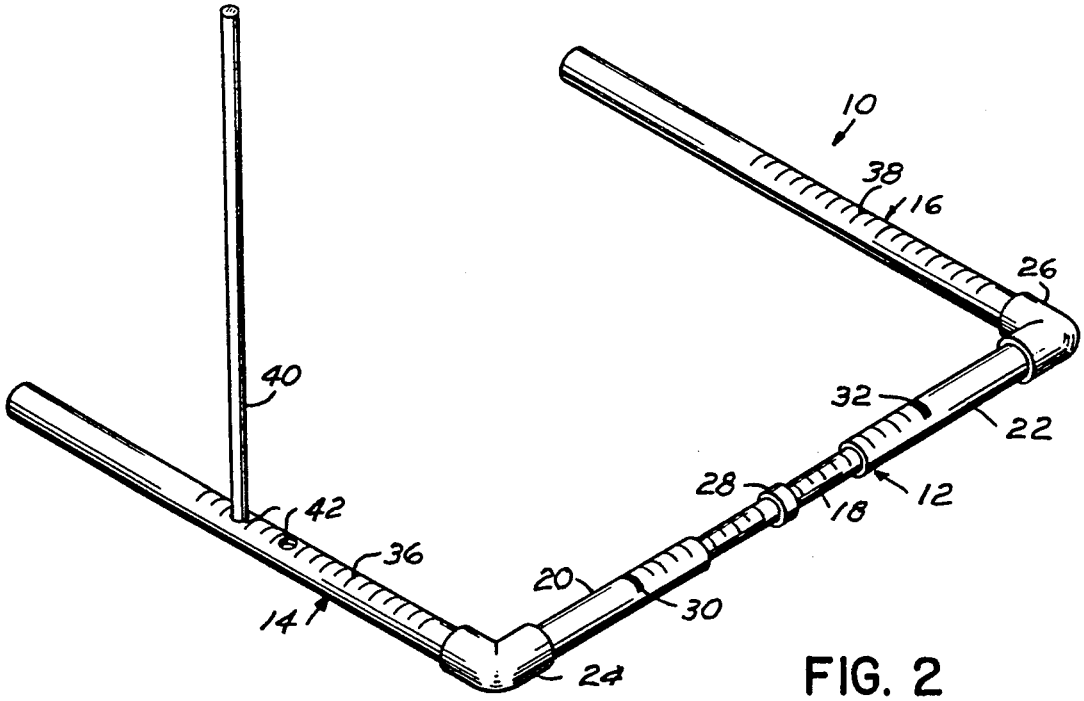
FIG. 2 is a similar perspective view of the stance guide, per se.
Figure 3:
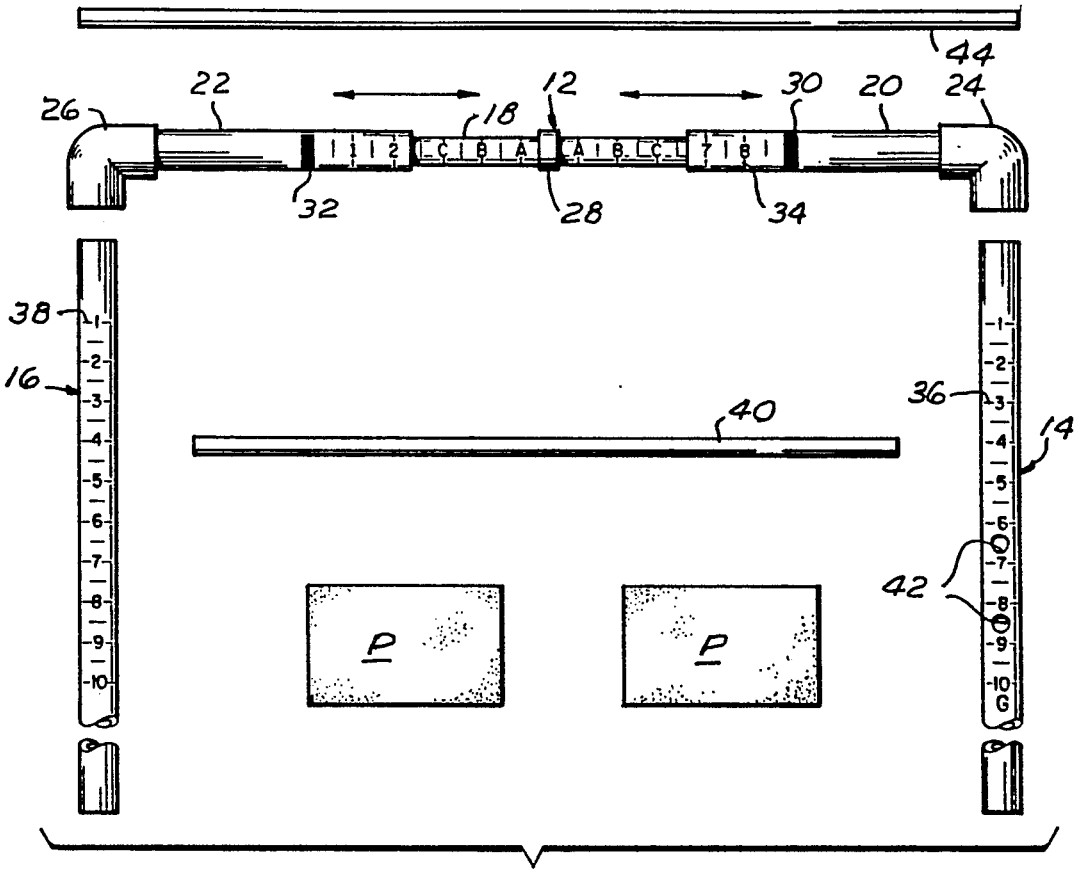
FIG. 3 is a partially exploded top plan view of the several components of the stance guide; and, FIG. 4 is a diagrammatic top view of the device illustrating a square stance position of a golfer's feet.

Like characters of reference designate like parts in those figures of the drawings in which they occur.

In the drawings:

The reference numeral 10 indicates the device which is preferably formed from polyethylene tubular material and is inverted U-shape in general configuration, defined by a straight bight portion 12 normal to its legs 14 and 16.

The bight portion 12 comprises a center member 18 telescopically received in friction sliding relation at its respective ends by tubular end member extensions 20 and 22, in turn slidably inserted at their respective end portions, opposite the center member 18, into elbows 24 and 26, respectively.

Obviously the respective leg elbow and adjacent end portion 14 or 16 of the bight portion may be formed in unitary fashion if complete collapsibility is not desired.

The right and left elongated tubular legs 14 and 16 are respectively frictionally inserted at one end portion into the other opening of the respective elbow to complete the U-shaped configuration.

The bold line 28 on the center member 18 indicates its center and the right and left bold lines 30 and 32 on the respective telescoping members 24 and 26 indicate a golfer's shoe heel alignment position, as presently explained.

Indicia or scales, comprising uniformly spaced-apart scored lines 34 on the center member 18 and telescoping members 20 and 22 indicate increments of measurement between any two lines, for example 1" (2.54 cm), for the purposes presently explained. The score lines value preferably being indicated by indicia, such as Arabic numerals.

Similarly, other identical scales, indicated by similar scored lines 36 and 38 and indicia on the leg members 14 and 16, extend from the respective elbow 24 and 26 toward the end of the leg members 14 and 16 opposite the elbows, for the purposes presently explained.

Obviously the scales and indicia may be printed on strips of sheet material and bonded to or removably bonded to the respective members of the bight portion 12 and leg members 14 and 16.

A dowel rod 40 of selected length, for example 18" (45.72 cm), is vertically supported by one end portion disposed in one of a pair of holes 42 formed in the leg 14 intermediate its ends for the purposes presently explained.

An elongated rod 44 of selected length, for example 2 feet (60.96 cm), forms part of the device for alignment of the longitudinal axis of the bight portion 12 with respect to the desired path of a ball to a target, as presently explained.

OPERATION

In operation, assuming the U-shaped device 10 with the exception of the dowel 40 has been assembled as described hereinabove.

The spacing between the legs 36 and 38 is adjusted to the width of the user's shoulders. This is accomplished by horizontally disposing the device 10 with the legs 36 and 38 on opposing sides of the individual and telescopically collapsing or expanding the members 18, 20 and 22, so that the respective legs 36 and 38 contact the respective upper arm or shoulder portion of the user.

This measurement between the legs is expanded by telescopically expanding each of the end members 20 and 22 relative to the center member 18 one inch (2.54 cm) on either side of the user's shoulder.

This distance between the legs 36 and 38 of the device is the ideal distance for the spacing of the user's feet in achieving a proper stance and is accomplished by placing the unit on the ground and the user placing his feet within the device with the side of each shoe adjacent, but not under, the respective leg 36 and 38 and the shoe toes adjacent the respective end portion of the telescoping members 20 and 22 at their connection with the respective elbow 24 and 26.

By way of example, for a driving practice shot, determine a line from the ball to the target (not shown) and align the axis of the bight portion 12 parallel with the line to the target. Place the golf ball B approximately 2 feet (0.6 meter) forwardly of the left heel mark 32, for a right handed golfer, so that a line through the ball and the heel mark 32 is parallel with the left leg 38. One end portion of the dowel 40 is disposed within one of the holes 42. Place the rod 44 approximately 6" (15.24 cm) forwardly beyond the ball B opposite the bight portion 12 and parallel with the desired line to the target and with the axis of the bight portion 12. While standing within the device 10, as illustrated by FIG. 1, place a driver club head directly centered behind the ball.

In addressing the ball, follow the known procedures for a ball driving swing, such as, bending the knees slightly, keeping a straight back and weight evenly distributed on the balls of the feet during the back swing. The right knee touching the dowel 40 indicates an improper back swing and practice should be continued until the right knee does not touch the dowel.

As is well known, a golf swing may be improved during practice by placing the respective felt or foam pads P under a golfer's arm pits. During the swing the pads should not fall from under the arms until the follow through is complete.

The indicia 34 on the bight portion 12 is useful in positioning the bight portion 12 relative to a golf ball to be driven when using clubs of different length in which the bight portion 12 is positioned closer to the ball and indicia lines aligned with the ball as the number of the golf club increases.

The device is useful in correctly achieving a closed stance for a draw or hook in driving a ball toward a target around an obstruction between the ball and the target.

Figure 4:
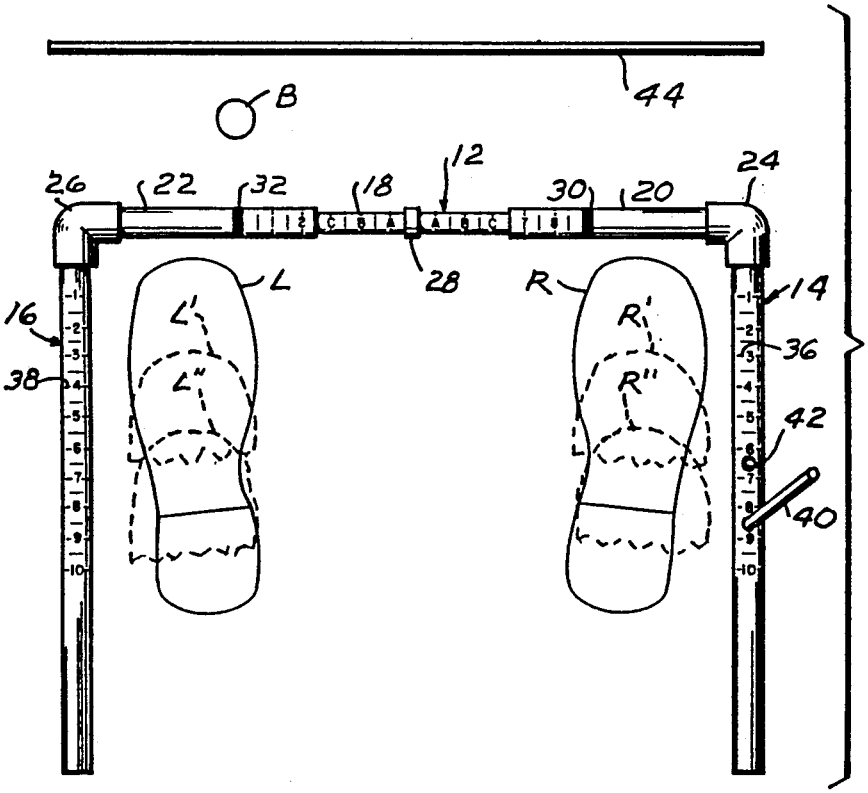

For a closed stance draw, the device is set for a square stance (FIG. 4) with a ball B aligned with the left heel mark 32 as described hereinabove.

The right foot R is moved rearwardly to the third score line from the elbow 24 on the right leg 14, as indicated by the dotted lines R', so that a line extending across the toes will be to the right of the target. The rod 44 is then positioned approximately 6" (15.24 cm) beyond the ball opposite the device 10 and parallel with the line across the toes to the right of the target. The club face should remain square to the target and when driven toward a point to the right of the target the ball travels from right to left with a counterclockwise spin.

For a closed stance hook, the same position is used as described for the closed stance draw with the exception the right foot is moved rearwardly until the toe is parallel with the fifth or sixth score line on the leg 14 as indicated by the dotted lines R'.

An open stance fade or an open stance slice is used for moving the ball around an obstacle between the ball and a target on the opposite side from that described for the closed stance draw.

The open stance fade is achieved by setting the device at a square stance with the ball aligned with the center mark 28. The left foot L is then moved rearwardly with the toe parallel with the third indicia score line 38 on the leg 16 as indicated by the dotted lines L'.

For an open stance slice the left foot position is moved rearwardly to the fifth or sixth indicia score line 38 on the leg 16, as indicated by the dotted lines L" resulting in a clockwise spin on a ball when driven toward the target.

For putting, the basic square stance is generally used in which the bight portion 12 is positioned parallel with a line from the ball to the target, and the rod 44 parallel with the bight portion 12 and the line through the ball to the target. The spacing between the bight portion 12 and rod 44 being approximately 5" (12.7 cm), so that the space or distance between the respective ends of the putter, when positioned behind the ball, is approximately one half inch (1.27 cm) from the adjacent surface of the bight portion 12 and rod 44.

Obviously the invention is susceptible to changes or alterations without defeating its practicability. Therefore, we do not wish to be confined to the preferred embodiment shown in the drawings and described herein.

We claim:

1. A golf stance guide, comprising:

an inverted U-shaped tubular member having a telescopically extensible straight bight portion and parallel legs and adapted to be disposed on a playing surface and having the spacing between its legs substantially equal with the width of a golfer's shoulders for defining the optimum spacing of a golfer's feed and respective end portions of the bight portion adjacent the toes of a golfer's shoes and oriented substantially parallel with a desired target line, said bight portion including:

a center member;

end members telescopically receiving respective end portions of the center member; and, elbows removably connecting the end members with the respective said legs.

2. The stance guide according to claim 1 and further including:

a dowel vertically supported by one said leg for defining a stance vertical boundary limit at one side of a golfer.

* * * * *